US006602069B2

(12) United States Patent
Purchase

(10) Patent No.: US 6,602,069 B2
(45) Date of Patent: Aug. 5, 2003

(54) PLUG MEMBERS FOR STEEL FURNACES

(75) Inventor: Wynne Purchase, Port Talbot (GB)

(73) Assignee: Goricon Metallurgical Services Limited, Bridgend (GB)

( * ) Notice: Subject to any disclaimer, the term of this patent is extended or adjusted under 35 U.S.C. 154(b) by 0 days.

(21) Appl. No.: 09/958,357

(22) PCT Filed: Feb. 8, 2001

(86) PCT No.: PCT/GB01/00476

§ 371 (c)(1),
(2), (4) Date: Jan. 2, 2002

(87) PCT Pub. No.: WO01/59383

PCT Pub. Date: Aug. 16, 2001

(65) Prior Publication Data

US 2002/0155409 A1 Oct. 24, 2002

(30) Foreign Application Priority Data

Feb. 8, 2000 (GB) ..... 0002895

(51) Int. Cl.[7] ..... B22D 41/08

(52) U.S. Cl. ..... 432/250; 266/271; 266/272; 222/597

(58) Field of Search ..... 432/250; 110/173 R; 266/271, 272; 222/597, 602

(56) References Cited

U.S. PATENT DOCUMENTS 4,709,903 A 12/1987 LaBate
5,451,036 A 9/1995 Eastwood

FOREIGN PATENT DOCUMENTS

DE 198 21 981 A1 8/1999

*Primary Examiner*—Gregory Wilson

(57) ABSTRACT

A dart has a metal bar 1 passing through a ceramic, shaped, dart head 2 and then through a cylindrical ceramic dart stem 3. A sleeve 4 of a carbonaceous or reactive material is provided about the stem 3 or a layer of that material can be formed on the lower face 5 of the dart head 2 (at the interface of the steel and slag). A block or sleeve 6 of suitable reactive material could be positioned on the top face 7 of the dart. The reactive material could be cardboard or paper, or a reactive metal, such as aluminum or magnesium. In each case a chemical reaction with the molten steel will result in an updraft in the steel which clears slag from the area of the tap hole.

6 Claims, 1 Drawing Sheet

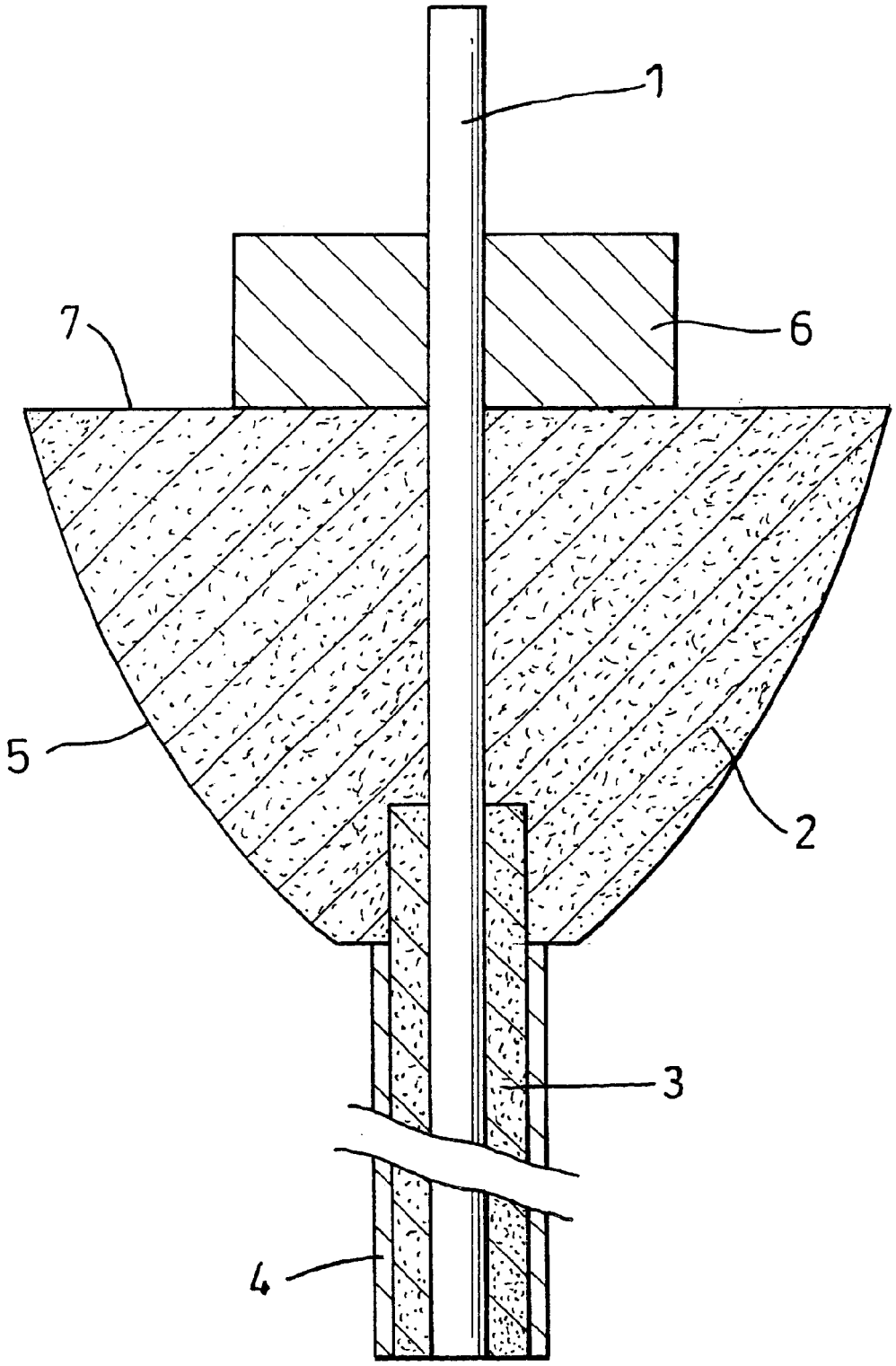
1
6
7
5
2
3
4

PLUG MEMBERS FOR STEEL FURNACES

FIELD OF THE INVENTION

This invention relates to steel furnaces of the form referred to by the term "tap-off converter", namely a convertor which can be tilted so that molten metal therein is able to be drawn off through a tap hole.

BACKGROUND OF THE INVENTION

The operator needs to know when slag is about to flow, or has started to flow, through the tap hole so that pouring of the steel can be discontinued. A conventional method of doing this employs a plug member (commonly called a "dart") whose specific gravity is less than that of the steel, but greater than that of the slag, so that the dart tends to "float" at the interface between the molten steel and slag. The dart has a lower stem, which locates freely into the tap hole. The enlarged head of the dart, when it eventually lowers into position, will then close off the tap hole, at least partially, as the slag layer approaches the tap hole. What happens, in effect, is that the flow of material through the tap hole is substantially reduced as the dart head covers over or enters the tap hole. This enables the operator to allow most of the residual pool of molten steel to run off until such time as the slag itself starts to run off, whereupon the convertor can be tipped back again to retain the rest of the slag.

However, due to the vortex that is formed as the steel is discharging from the furnace, slag can still be drawn through the tap hole from above the steel still present in the furnace. We have discovered that if a reactive material such as carbonaceous material (e.g. wood, cardboard) or a reactive metal (e.g. aluminium), or a combination of these materials, is attached to or integrated with the dart head or stem, gases are created such that a bubbling reaction or turbulence will be set up around the dart and tap hole. This will act to disperse slag from around the area of the tap hole. The reaction serves to reduce the possibility of slag being drawn into the vortex and hence passing into the ladle below. As the purpose or the slag dart is to minimise slag that passes through the tap hole onto the ladle, this development will serve to enhance the effectiveness of the dart in performing its intended use.

SUMMARY OF THE INVENTION

According to the present invention, there is provided a tap hole dart for a steel furnace, having an enlarged head from which projects downwardly a stem which is designed to locate in the tap hole, the upper and/or lower face of the dart head and/or the stem being provided with a layer or sleeve of reactive material in the form of carbonaceous material or a reactive metal or a combination thereof.

The material which will cause the reaction could be added to the head or stem during manufacture, thus integrating the reactivity into the head and stem.

The term "reactive metal" defines a metal which will vaporise or react with the steel at molten steel temperatures to create bubbling or turbulence of the liquid steel, without creating unacceptable contamination of the steel. Suitable metals for this purpose are aluminium and magnesium. Preferred carbonaceous materials are paper, cardboard or wood.

BRIEF DESCRIPTION OF THE DRAWINGS

The invention may be performed in various ways and a preferred embodiment thereon will now be described with reference to the accompanying drawing which is a vertical section through a tap hole dart.

DETAILED DESCRIPTION OF THE INVENTION

The dart shown in the drawing has a metal bar 1 passing through a ceramic, shaped, dart head 2 and then through a cylindrical ceramic dart stem 3. In use, the stem 3 is located in the tap hole of a steel converter as the molten steel is drawn off. When the surface of the molten steel (carrying a layer of slag) approaches the tap hole, the dart head 2 reduces the passageway and tends to block the slag from entering the tap hole. However, a vortex effect can tend to drag the slag down into the tap hole. This effect can be reduced substantially, as will be explained below, by providing a sleeve 4 of a carbonaceous or reactive material about the stem 3 (essentially in the steel to cause bubbles to rise up through the slag). It would be possible, additionally or alternatively, to provide a layer of that material on the lower face 5 of the dart head 2 (at the interface of the steel and slag). A block or sleeve 6 of suitable reactive material could also be positioned on the top face 7 of the dart (essentially in the slag).

Cardboard is laminated paper, an organic compound. Paper is made mainly of cellulose, a sugar polymer. This has the general formula of $C_n(H_2O)_n$. It is believed that, at molten steel/slag temperatures, this breaks down exothermically into many substances, mainly carbon (C), water ($H_2O$), carbon monoxide (CO), and carbon dioxide ($CO_2$). The C released would be solid and would be absorbed into the steel/slag. The CO, $CO_2$ and $H_2O$ are all in a gaseous state. The gases evolved would rise around the stem so causing an upward current in the steel. This would have the effect of moving material at the surface away from the location of the dart, so forming a slag-free eye around the area of the tap hole. Most carbon-based materials are assumed to react in this way.

Other reactive materials can be used as a substitute for or in addition to a carbon-based substance. Reactive metals, such as aluminium or magnesium, are an example of such materials. In this case, the reaction is a straightforward reaction between the metal and the dissolved oxygen in the slag and steel. This is a vigorous exothermic reaction and vaporisation of metal results in great turbulence and again the creation of an upward current in the steel.

Although the chemical reactions are different in each case, the overall result is of an updraft in the steel which clears the slag from the area of the tap hole.

What is claimed is:

1. A tap hole dart for a steel furnace, having an enlarged head from which projects downwardly a stem which is designed to locate in a tap hole, the upper and/or lower face of the dart head and/or the stem being provided with a layer or sleeve of reactive material in the form of carbonaceous material or a reactive metal or a combination thereof, which reactive material will vaporise or react with molten steel to create bubbling or turbulence of the molten steel.

2. A dart according to claim 1, wherein the reactive material has been added to the head or stem during manufacture, thus integrating the reactive material into the head and stem.

3. A dart according to claim 2, wherein the reactive metal is one which will vaporise or react with the steel at molten steel temperatures to create bubbling or turbulence of the liquid steel, without creating unacceptable contamination of the steel.

4. A dart according to claim 1, wherein the reactive metal is one which will vaporise or react with the steel at molten steel temperatures to create bubbling or turbulence of the liquid steel, without creating unacceptable contamination of the steel.

5. A dart according to claim 4, wherein the metal for this purpose are aluminium and magnesium.

6. A dart according to claim 1, wherein the carbonaceous material is selected from paper, cardboard and wood.

* * * * *